US005975843A

United States Patent [19]

Ebihara

[11] Patent Number: 5,975,843

[45] Date of Patent: Nov. 2, 1999

[54] FLUID SUPPLY DEVICE HAVING IRREGULAR VANE GROOVES

[75] Inventor: Yoshio Ebihara, Kariya, Japan

[73] Assignee: Denso Corporation, Kariya, Japan

[21] Appl. No.: 09/127,868

[22] Filed: Aug. 3, 1998

[30] Foreign Application Priority Data

Aug. 6, 1997 [JP] Japan ..... 9-211775

[51] Int. Cl.[6] ..... F04D 5/00

[52] U.S. Cl. ..... 415/119; 415/55.1

[58] Field of Search ..... 415/119, 55.1, 415/55.2, 55.3, 55.4; 416/203

[56] References Cited

U.S. PATENT DOCUMENTS

| | | | |
|---|---|---|---|
| 3,006,603 | 10/1961 | Caruso et al. | 415/119 X |
| 3,418,991 | 12/1968 | Shultz et al. | 417/366 X |
| 3,556,680 | 1/1971 | Leutwyler et al. | 415/119 X |
| 3,881,839 | 5/1975 | MacManus | 415/55.4 |
| 3,947,149 | 3/1976 | MacManus | 415/55.4 |
| 3,951,567 | 4/1976 | Rohs | 415/119 |
| 4,209,284 | 6/1980 | Lochmann et al. | 415/198.2 X |
| 4,253,800 | 3/1981 | Segawa et al. | 415/119 X |
| 4,474,534 | 10/1984 | Thode | 416/203 |
| 4,923,365 | 5/1990 | Rollwage | 415/119 |
| 5,163,810 | 11/1992 | Smith | 415/55.1 |
| 5,302,081 | 4/1994 | Smith | 415/55.1 |

FOREIGN PATENT DOCUMENTS

| | | | |
|---|---|---|---|
| 3811990 | 10/1988 | Germany | 415/55.1 |
| 60-85288 | 5/1985 | Japan . | |
| 5-179941 | 5/1993 | Japan . | |
| 7-97999 | 4/1995 | Japan . | |

*Primary Examiner*—John Ryznic
*Attorney, Agent, or Firm*—Nixon & Vanderhye P.C.

[57] ABSTRACT

A fluid supply device such as a fuel pump has an impeller 24 on which vanes and vane grooves are arranged alternately on its outer circumference. All adjacent groove angles, each of which is defined by the adjacent two vane grooves, are different from each other. Among the arrangement of the vane grooves, a sum Sm of the angles of the vane grooves which are adjacent in succession in the number of m=n/k (k=2, 3 and 4) is determined. If the number n/k is not an integer, at least (n/k)+1 between n/k and (n/k)+1 is set as m. The sum Sm is determined n-times by shifting the vane groove, from which the sum is determined each time, in the circumferential direction one by one. The arrangement in which the sum Sm of each time satisfies the following relation is adopted: $(360/k)-10 \leqq Sm \leqq (360/k)+10$.

6 Claims, 4 Drawing Sheets

FLUID SUPPLY DEVICE HAVING IRREGULAR VANE GROOVES

CROSS REFERENCE TO RELATED APPLICATION

This application relates to and incorporates herein by reference Japanese Patent Application No. 9-211775 filed on Aug. 6, 1997.

BACKGROUND OF THE INVENTION

The present invention relates to a fluid supply device which has vanes and vane grooves on an outer circumferential periphery of a rotary member.

It is proposed in JP-A 60-85288 that a fluid pump as a fluid supply device has an impeller on which vane grooves having different groove widths are provided on its outer circumferential periphery. More specifically, a set of vane grooves of different groove widths are arranged in a predetermined pattern on a part (fixed pitch) of the outer periphery of the impeller, and the set of vane grooves are arranged in repetition over the entire outer periphery of the impeller. This arrangement reduces peak of sound pressure generated at high frequencies corresponding to the product of the number of vanes and the rotational speed of the impeller.

However, because the set of vane grooves in the predetermined pattern appears repeatedly or regularly in one rotation of the impeller, a low frequency noise sound is generated each time the impeller rotates by the fixed pitch of pattern repetition. Thus, if this type of pump is used as an in-tank fuel pump for an internal combustion engine, the low frequency sound is likely to resonate with the fuel tank and generate a low frequency noise sound.

SUMMARY OF THE INVENTION

It is therefore an object of the present invention to provide a fluid supply device which generates less noise sound.

According to the present invention, a fluid supply device has an impeller on which vane grooves of different width are arranged irregularly on the entire outer circumferential periphery. All the widths of the vane grooves may be different, or some of the widths of the same may be the same as long as the vane grooves of the different widths are arranged not locally but over the entire outer periphery.

Thus, each vane between an adjacent two of the vane grooves passes at irregular time intervals a partition wall provided between an inlet port and an outlet port. As the fluid pressure difference caused by each vane hits the partition wall at irregular time intervals, the peak sound pressure is lowered at both low frequencies and high frequencies, that is, at high rotational speeds and low rotational speeds of the impeller.

BRIEF DESCRIPTION OF THE DRAWINGS

Other objects, features and advantages of the present invention will become more apparent from the following detailed description made with reference to the accompanying drawings. In the drawings.

DETAILED DESCRIPTION OF THE PREFERRED EMBODIMENT

The present invention is described in detail with reference to a preferred embodiment in which a fluid supply device is applied to a fuel pump for an internal combustion engine.

Figure 1:
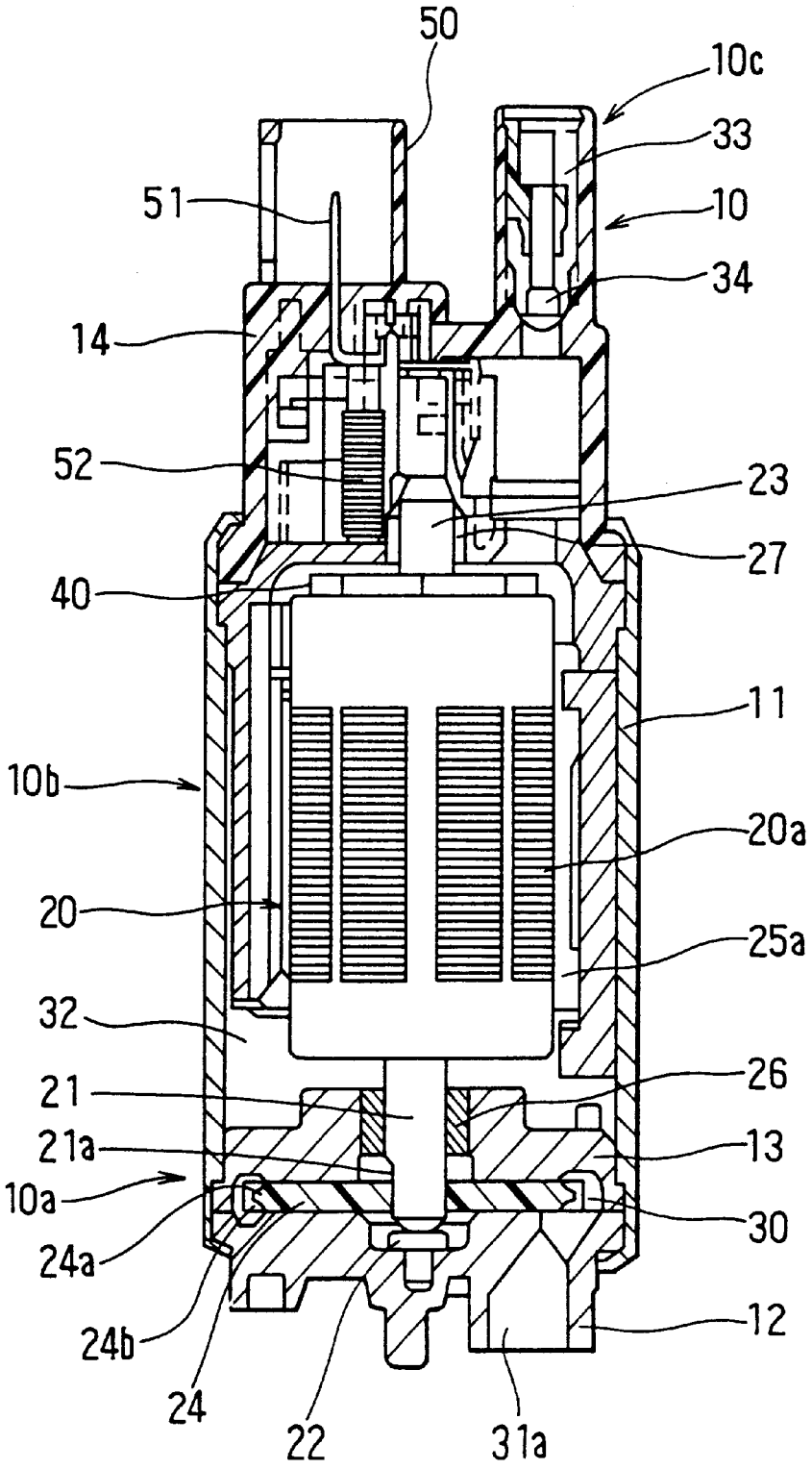
FIG. 1 is a sectional view showing a fuel pump according to an embodiment of the present invention.

Referring first to FIG. 1, a fuel pump is denoted by reference numeral 10 and, as known well in the art, located inside a fuel tank of an automotive vehicle (not shown), for instance, to supply fuel from the fuel tank to a fuel injection device of an internal combustion engine. The fuel pump 10 comprises a pump unit 10*a* for sucking fuel from the fuel tank and pressurizing the fuel, a motor unit 10*b* for driving the pump unit 10*a,* and a fuel discharging unit 10*c* for discharging the fuel pressurized by the pump unit 10*a.*

The pump unit 10*a* has a C-shaped pump chamber 30 (FIG. 2A) between its pump cover 12 and a pump casing 13. The chamber 30 rotatably houses a disk-shaped impeller 24 therein as a rotary member for pressurizing fuel. The pump cover 12 and the pump casing 13 are made of aluminum and fixed to a cylindrical housing 11.

Figure 2A:
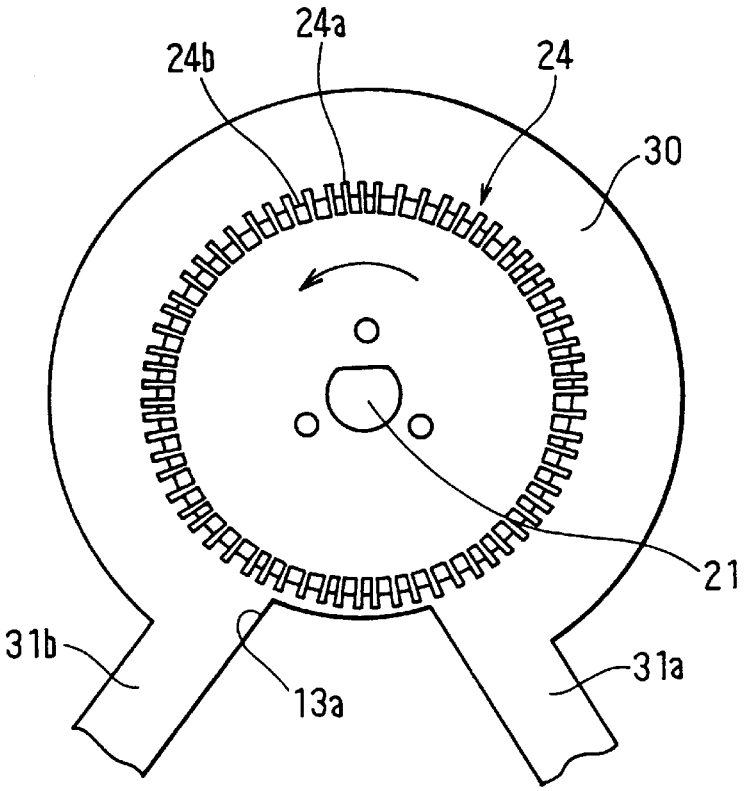
FIG. 2A is a plan view showing an impeller of the fuel pump shown in FIG. 1.
Figure 2B:
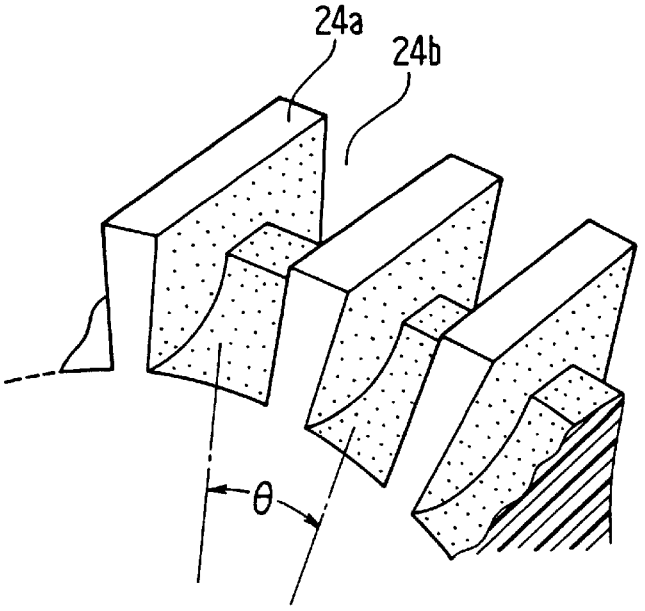
FIG. 2B is a perspective view showing partially the impeller shown in FIG. 2A.

As shown in FIGS. 2A and 2B in detail, the impeller 24 has sixty-seven vanes 24*a* on its outer circumferential periphery and sixty-seven vane grooves 24*b* between the vanes 24*a.* The width of each vane 24*a* is uniform (same), while each width (pitch) between an adjacent two of the vanes 24*a* is different. Thus, an adjacent two of the vane grooves 24*b* on both sides of vane 24*a* has a different width and a different adjacent groove angle θ.

The fuel sucked into the pump chamber 30 through an inlet port 31*a* formed on the pump cover 12 is pressurized by rotation of the impeller 24 and is discharged to a motor chamber 32 of the motor unit 10*b* through an outlet port 31*b.* The pump casing 13 is formed with a partition wall 13*a* at the connection of the pump chamber 30 and the outlet port 31*b.* The partition wall is disposed closely to the outer periphery of the impeller 24 to provide a seal between the inlet port 31*a* and the outlet port 31*b.*

Referring back to FIG. 1, the motor unit 10*b* has permanent magnets 25 which surround a rotor 20 wound with coils 20*a.* The rotor 20 rotates when electric current is supplied from a connector pin 51 of a connector 50 to the coils 20*a* disposed in the magnetic field of the magnets 25. A rotary shaft 21 at the side of thrust direction of the rotor 20 is supported by a thrust bearing 22 press-fitted into the central recess of the pump cover 12. The thrust bearing 22 receives the load from the rotary shaft 21 in the thrust direction, while a bearing 26 supports the rotary shaft 21 in the radial direction. A bearing 27 supports in the radial direction a rotary shaft 23 provided at the other side of the rotor 20. The rotary shaft 21 is formed with a cut 21*a* extending axially on its outer periphery at its end. The impeller 24 is firmly fitted onto the rotary shaft 21 at the location where the cut 21*a* is formed.

The magnets 25 are disposed radially outside the outer periphery of the rotor 20 with a gap relative to the rotor 20. A commutator 40 comprising eight copper segments is attached to the rotor 20 at the side of the rotary shaft 23.

A discharge case 14 is firmly fitted to the other end of the housing 11. The connector pin 51 is embedded in the connector 50 of the discharge case 14 with its top end being exposed. The connector pin 51 is connected to the coils 20*a* of the rotor 20 through the commutator 40. The connector pin 51 is connected to a choke coil 52 which eliminates alternating current components from the d.c. current to be supplied to coils 20*a*. The discharging unit 10*c* houses a check valve 34 in an outlet port 33 formed in the discharge case 14. The check valve 34 restricts reverse flow of fuel discharged from outlet port 33.

In this fuel pump 10, the rotor 20 rotates with its rotary shaft 21 being supported by the thrust bearing 22 and the bearing 26 and with its rotary shaft 23 being supported by bearing 27. The impeller 24 rotating with rotary shaft 21 pressurizes fuel sucked into the pump chamber 30 from the fuel tank through a filter (not shown) and feeds the fuel into motor chamber 32. The fuel then lifts check valve 34 upward to discharge to the outside through outlet port 34 and a fuel pipe (not shown).

During rotation of impeller 24, a difference occurs in pressures generated at the front and rear sides of each vane 24*a* in the rotating direction, and fuel having this pressure difference hits partition wall 13*a* of pump casing 13 formed closely to the outer periphery of impeller 24. As a result, it is likely that a large noise sound is generated when fuel having the large pressure difference hits partition wall 13*a* of pump casing 13, unless the angle of vane groove 24*b* formed in the impeller 24 is set properly.

The vane grooves 24*b*, which are sixty-seven in number in this embodiment, are arranged on impeller 24 in the following procedure.

(1) The maximum value θmax (°) and the minimum value θmin (°) of the pitch between an adjacent two of vane grooves 24*b*, i.e., the angle (adjacent groove angle) between the centers of the vane grooves 24*b*, are determined. The difference between those two angles are divided equally by sixty-six, which is one less than the total number of the vane grooves 24*b* to determine an increment angle Δ (°). A too large difference between the maximum angle θmax and the minimum angle θmin decreases the ratio of fuel discharg amount relative to electric power supplied to motor unit 10*b*, i.e., the efficiency of fuel pump 10. On the other hand, a too small difference between the maximum angle θmax and the minimum angle θmin will result in an impeller having uniform adjacent groove angles. This increases sound pressure at high frequencies which correspond to the product of the number of vanes 24*a* and the rotational speed of impeller 24. The appropriate difference between the maximum angle θmax and the minimum angle θmin of the adjacent groove angle may be determined through experiments and analyses for each type of pump.

(2) Random numbers, which are equal to the total number (n) of vane grooves 24*b* in number, are determined in sequence. Each random number is assigned with a sequence number (i) incrementally in the order of determination. Those sequence numbers (i) are assigned to the entire circumferential periphery of impeller 24 in an incrementing or decrementing order. Based on the incrementing or decrementing order of the random number, arrangement numbers (j) from one to sixty-seven are assigned to the random numbers [j=f(i)] in correspondence with the sequence numbers. Assuming that each adjacent groove angle of the vane grooves 24 to be assigned to the position which corresponds to the sequence number (i) assigned to the outer periphery of impeller 24 defined as θi (i=1, 2, . . . , n), the angle θi (°) is expressed as follows.

$$\theta i = \theta \min + \Delta \times (j-1) \quad (1)$$

Among the above arrangement of vane grooves 24*b*, a sum Sm (°) of the angles of vane grooves 24*b* which are adjacent in succession in the number of m=n/k (k=2, 3 and 4) is determined. Here, if the number n/k is not an integer, at least (n/k)+1 between n/k and (n/k)+1 is set as m. The sum Sm is determined n-times by shifting the vane groove, from which the sum is determined each time, in the circumferential direction one by one. The arrangement in which the sum Sm of each time satisfies the following relation is adopted.

$$(360/k)-10 \leqq Sm \leqq (360/k)+10 \quad (2)$$

Through calculations of the sum Sm while changing k in the range which includes 2, 3 and 4 to the number of segments of the commutator 40 (8 in this embodiment) and experiments of the resulting arrangements, the sound pressure generated by the rotation of impeller 24 can be reduced advantageously.

Figure 3:
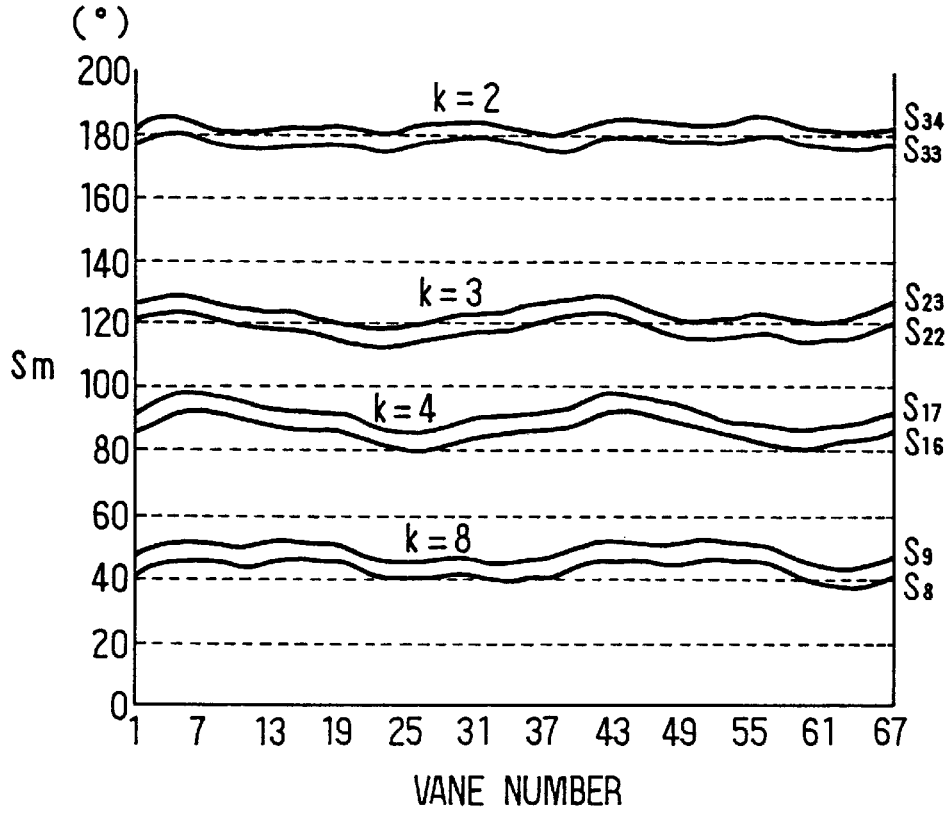
FIG. 3 is a characteristics chart showing variations in the sum of adjacent groove angles in one case.

As shown in FIG. 3, the sum Sm of the adjacent groove angles of the vane grooves 24*b* varies when the number k is changed as k=2, 3, 4, 8. In FIG. 3, it is assumed that the vane grooves 64*b* are denoted by numbers starting from 1 to 67 sequentially in the clockwise direction. The sum Sm (S8, S9, S16, S17, S22, S23, S33, S34) of each adjacent groove angle is determined with m=8 and 9 for k=8, m=16 and 17 for k=4, m=22 and 23 for k=3, and m=33 and 34 for k=2, because the total number of the vane grooves 24*b* is sixty-seven (n=67). As understood from FIG. 3, all the sums Sm of adjacent groove angles are generally within a range of (360/2=180) ±10 for k=2, (360/3=120)±10 for k=3, (360/4=90)±10 for k=4, and (360/8=45)±10 for k=8, respectively. Thus, because all the adjacent groove angles of vane grooves 24*b* are different from each other in this embodiment, high frequency noise sound can be reduced to a minimum. Further, because variations in the adjacent groove angles of vane grooves 24*b* are not concentrated on only a part of the impeller 24 but distributed all over the impeller 24 in the circumferential direction, the number of vanes 24*a* passing through the partition wall 13*a* in a unit time interval does not change so much. Thus, generation of low frequency noise sound will also be suppressed.

Using more sets of random numbers, the sums Sm of adjacent groove angles are determined as above. The arrangements which result in smaller variations in the sum Sm than those shown in FIG. 3 are selected and shown in FIG. 4. Those vane groove arrangements having less variation in the sum Sm result from more irregularly arranged vane grooves and provide more advantageous arrangements which produces lower sound pressure.

Figure 4:
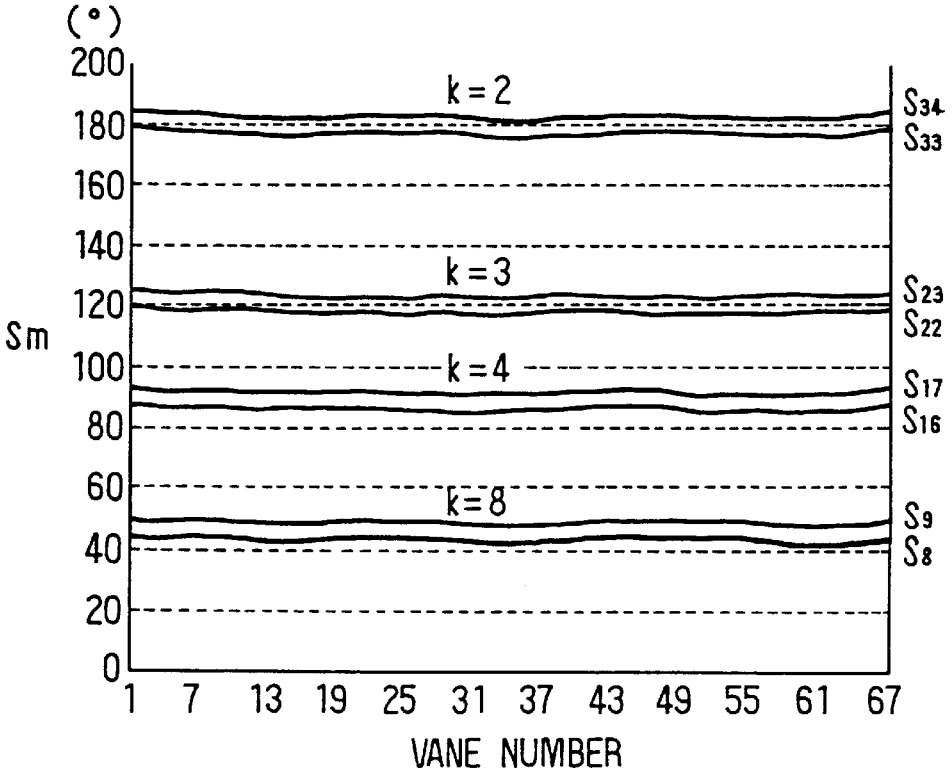
FIG. 4 is a characteristics chart showing variations in the sum of adjacent groove angles in another case.
Figure 5:
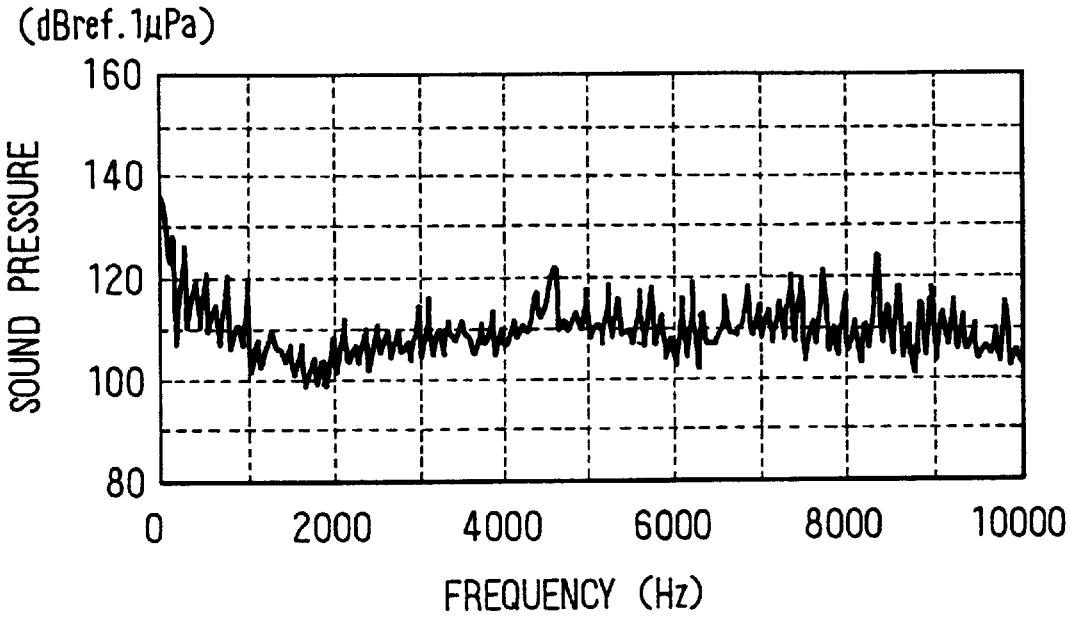
FIG. 5 is a characteristics chart showing measured sound pressure relative to frequency in the another case.
Figure 6:
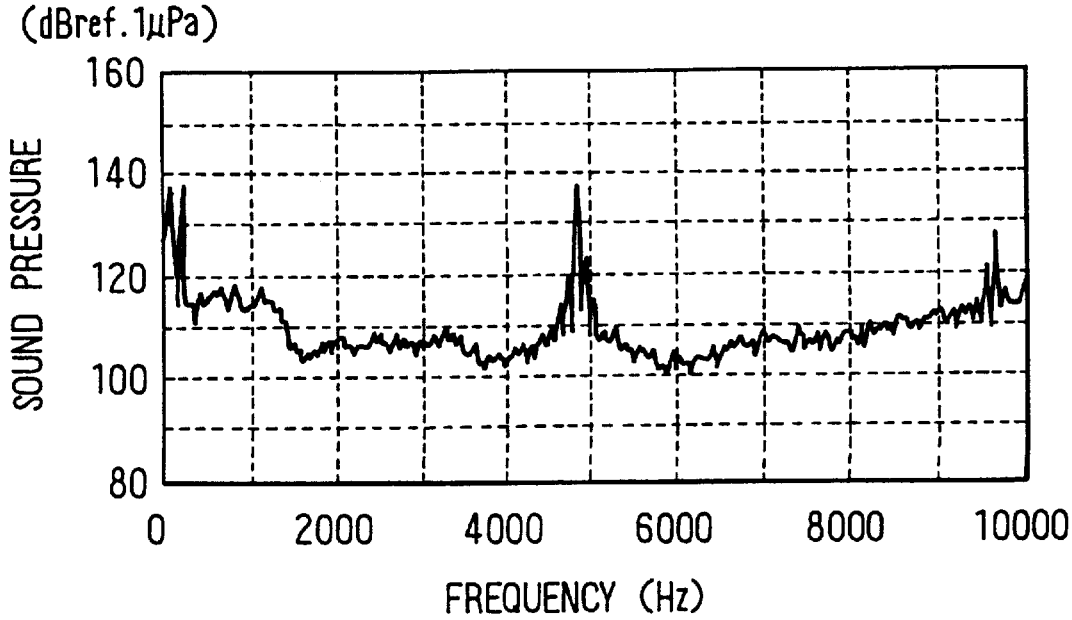
FIG. 6 PRIOR ART
FIG. 6 is a characteristics chart showing measured sound pressure relative to frequency in the conventional case.

Sound pressure generated by an impeller using the vane groove arrangement of FIG. 4 and an impeller using the uniform vane groove arrangement (prior art) are measured in the same type of fuel pump (FIG. 1). The measured sound pressures relative to the frequency (rotational speed of the impeller 24) are shown in FIG. 4 (embodiment) and in FIG. 5 (prior art). In FIGS. 5 and 6, it is to be noted that the sound pressure was measured in a fluid, and 1 μPa is denoted as 0 dB. As understood from FIGS. 4 and 5, as long as the vane groove arrangement corresponding to a less-changing Sm-characteristics (FIG. 4) is adopted, peak level of the generated sound pressure is reduced to be lower (FIG. 5) and average level of the generated sound pressure is lowered over any rotational speed of the impeller.

According to the above embodiment, not only the noise sound pressure is lowered at both high frequencies and low frequencies, but also fluctuations corresponding to the difference in sound pressures are reduced. As a result, changes in the rotational speed of the impeller 24, which may be caused by the fluctuations, are also reduced. Thus, pump unit 10*a* is enabled to discharge fuel in generally direct proportion to electric power supplied to the motor unit 10*b*, that is, the fuel pump 10 can be operated at high efficiency.

The above embodiment may be modified in many ways. For instance, the random numbers may be used in different ways as long as the irregularity of random numbers is used. In determining the sum Sm of the adjacent groove angles, it may be determined with respect to only k=2, 3 and 4, and m=34, 23 and 17, i.e., for (n/k)+1. Some of the adjacent groove angles may be the same, as long as the ratio of the number of the same adjacent groove angle to the total number of the vanes is less than or equal to 0.1.

In place of the open-type vane structure in which the vane grooves 24*b* at the front side and the rear side of the impeller are communicated in the axial direction, a closed-type vane structure may be used. Even in the open-type vane structure, the impeller 24 may be a type which has an annular ring having a width equal to the thickness of the impeller 24 (axial length of the vane 24*a*) and connecting the radially outermost ends of the vanes 24*a* arcuately over the vane grooves 24*b*.

What is claimed:

1. A fluid supply device comprising:

a casing defining a chamber therein; and a rotary member disposed in the chamber and having vanes and vane grooves arranged alternately around an outer periphery thereof, wherein:

the vane grooves are arranged irregularly to provide adjacent groove angles different from each other, and a sum Sm of adjacent groove angles of a predetermined number of successive vane grooves is within a predetermined range of variation irrespective of the position of the first one of said predetermined number of vane grooves in a circumferential direction of the rotary member.

2. A fluid supply device as in claim 1, wherein:

some of the vane grooves are arranged to provide equal adjacent groove angles; and the ratio of the number of equal adjacent groove angles relative to the total number n of vanes is substantially less than 0.1.

3. A fluid supply device comprising:

a casing defining a chamber therein; and a rotary member disposed in the chamber and having vanes and vane grooves arranged alternately around an outer periphery thereof, wherein:

the vane grooves are arranged irregularly to provide adjacent groove angles between adjacent vane grooves that are different from each other, and a sum Sm of the adjacent groove angles of a predetermined number of the vane grooves arranged in succession is within a predetermined range of variation irrespective of position of a first one of the predetermined number of the vane grooves in a circumferential direction of the rotary member;

some of the vane grooves are arranged to provide the same adjacent groove angle;

a ratio of the number of the same adjacent groove angles relative to a total number n of vanes is substantially less than 0.1; and the sum Sm of adjacent groove angles of the vane grooves satisfy $(360/k)-10 \leqq Sm \leqq (360/k)+10$, in which the sum Sm is determined n-times by shifting in the circumferential direction one by one the first one of the vane grooves from which the sum is determined each time in the circumferential direction, and m is the number of vane grooves which are adjacent in succession and defined as m=n/k (k=2, 3 and 4), under a condition that at least (n/k)+1 between n/k and (n/k)+1 is set as m if the number n/k is not an integer.

4. A fluid supply device as in claim 1, wherein:

adjacent groove angles are determined by random numbers assigned to the vane grooves in the circumferential direction in an order of issuance of the random numbers.

5. A fluid supply device comprising:

a casing defining a chamber therein; and a rotary member disposed in the chamber and having vanes and vane grooves arranged alternately around an outer periphery thereof, wherein:

the vane grooves are arranged irregularly to provide adjacent groove angles between adjacent vane grooves that are different from each other, and a sum Sm of the adjacent groove angles of a predetermined number of the vane grooves arranged in succession is within a predetermined range of variation irrespective of position of a first one of the predetermined number of the vane grooves in a circumferential direction of the rotary member; and wherein:

all of the adjacent groove angles are different from each other.

6. A fluid supply device as in claim 5 wherein:

the sum Sm of adjacent groove angles of the vane grooves satisfy $(360/k)-10 \leqq Sm \leqq (360/k)+10$, in which the sum Sm is determined n-times by shifting in the circumferential direction one by one the first one of the vane grooves from which the sum is determined each time in the circumferential direction, and m is the number of vane grooves which are adjacent in succession and defined as m =n/k (k=2, 3 and 4), under a condition that at least (n/k)+1 between n/k and (n/k)+1 is set as m if the number n/k is not an integer.

* * * * *